US007936368B2

(12) United States Patent
Yamazaki

(10) Patent No.: US 7,936,368 B2
(45) Date of Patent: May 3, 2011

(54) IMAGE FORMING METHOD AND IMAGE FORMING APPARATUS

(75) Inventor: Kozo Yamazaki, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 562 days.

(21) Appl. No.: 12/071,661

(22) Filed: Feb. 25, 2008

(65) Prior Publication Data

US 2008/0218580 A1 Sep. 11, 2008

(30) Foreign Application Priority Data

Mar. 7, 2007 (JP) ..... 2007-056749

(51) Int. Cl.
*B41J 2/435* (2006.01)
*B41J 2/47* (2006.01)

(52) U.S. Cl. ..... 347/250; 347/224; 347/232; 347/234; 347/235; 347/236; 347/233; 347/237; 347/241; 347/243; 347/247; 347/248

(58) Field of Classification Search ..... 347/232, 347/234, 235, 243, 246, 250
See application file for complete search history.

(56) References Cited

U.S. PATENT DOCUMENTS

| | | | | |
|---|---|---|---|---|
| 4,853,710 | A | 8/1989 | Shimada et al. | |
| 5,673,136 | A * | 9/1997 | Inoue et al. | 359/205.1 |
| 5,883,385 | A * | 3/1999 | Takahashi et al. | 250/235 |
| 6,404,448 | B1 * | 6/2002 | Toda | 346/116 |
| 7,215,349 | B2 | 5/2007 | Sakaue et al. | |
| 2003/0128413 | A1 * | 7/2003 | Suzuki et al. | 359/205 |
| 2004/0100550 | A1 | 5/2004 | Bannai et al. | |
| 2004/0125195 | A1 * | 7/2004 | Satoh | 347/234 |
| 2005/0093962 | A1 * | 5/2005 | Miyatake et al. | 347/235 |
| 2006/0001891 | A1 * | 1/2006 | Yoshida | 358/1.9 |
| 2006/0055769 | A1 | 3/2006 | Yamazaki et al. | |
| 2006/0164504 | A1 * | 7/2006 | Kobayashi et al. | 347/233 |
| 2006/0209166 | A1 * | 9/2006 | Suzuki et al. | 347/231 |
| 2007/0053024 | A1 * | 3/2007 | Kitao | 358/518 |
| 2007/0153079 | A1 | 7/2007 | Sakaue et al. | |
| 2007/0211137 | A1 | 9/2007 | Yamazaki | |

FOREIGN PATENT DOCUMENTS

| | | |
|---|---|---|
| JP | 03-293679 | 12/1991 |
| JP | 09-244332 | 9/1997 |
| JP | 2000-301765 | 10/2000 |
| JP | 2003-322817 | 11/2003 |
| JP | 2004-246010 | 9/2004 |
| JP | 2004-271548 | 9/2004 |
| JP | 2006-011289 | 1/2006 |

* cited by examiner

*Primary Examiner* — Ryan Lepisto
(74) *Attorney, Agent, or Firm* — Harness, Dickey & Pierce, P.L.C.

(57) ABSTRACT

Positioning displacement characteristics of each of scanning beams are obtained in advance. The positioning displacement characteristics is indicative of a relation between temperature and a displacement amount by which each of the scanning beams is displaced in a sub-scanning direction. A displacement control is performed based on the positioning displacement characteristics by shifting the positioning displacement characteristics in a direction opposite to that of a trend of the positioning displacement characteristics within a pixel pitch.

11 Claims, 4 Drawing Sheets

IMAGE FORMING METHOD AND IMAGE FORMING APPARATUS

CROSS-REFERENCE TO RELATED APPLICATIONS

The present application claims priority to and incorporates by reference the entire contents of Japanese priority document 2007-056749 filed in Japan on Mar. 7, 2007.

BACKGROUND OF THE INVENTION

1. Field of the Invention

The present invention relates to a technology for forming a less color-shifted image.

2. Description of the Related Art

Existing color-image forming apparatuses in general are equipped with a plurality of photosensitive members and an optical scanner that includes a polygon mirror as an optical deflector to scan each photosensitive member. However, due to heat generated while the optical scanning device etc. is in operation, temperature inside the device increases as the time passes and each unit undergoes thermal expansion. Consequently, scanning beams that scan the photosensitive members may shift in a sub-scanning direction, and therefore the image quality deteriorates.

To overcome the above problem, a controlling method is disclosed in Japanese Patent Application Laid-open No. H3-293679 and Japanese Patent Application Laid-open No. H9-244332, by which temperature inside the apparatus is detected, image formation timing is corrected based on detection results, and the position of the image formed on the photosensitive members in a predetermined time is corrected.

As disclosed in Japanese Patent Application Laid-open No. 2004-246010, Japanese Patent Application Laid-open No. 2004-271548, and Japanese Patent Application Laid-open No. 2003-322817, the optical scanning device includes an airflow path, a fan, and a radiation fin, and prevents deterioration of image quality by suppressing the increase in temperature inside the optical scanning device.

However, in the technology disclosed in Japanese Patent Application Laid-open No. H3-293679 and Japanese Patent Application Laid-open No. H9-244332, the image-formation correction control makes the image forming apparatus complicated. Furthermore, in the technology disclosed in Japanese Patent Application Laid-open No. 2004-246010, Japanese Patent Application Laid-open No. 2004-271548, and Japanese Patent Application Laid-open No. 2003-322817, the increase in temperature inside the optical scanning device is controlled by installing fan etc. However, in recent times, for energy conservation and noise reduction, rotation speed of the fan inside the image forming apparatus is reduced or stopped in standby mode. Consequently, cooling efficiency drops considerably and usually it becomes difficult to cope up with the image quality deterioration.

In present conditions, laser printers and digital copying machines are required to have high quality image, high speed, occupy less space, energy conservation, low cost etc. Particularly, high image quality is essential for the color-image forming apparatus, and therefore it is important to deal with the problems regarding color alignment.

SUMMARY OF THE INVENTION

It is an object of the present invention to at least partially solve the problems in the conventional technology According to an aspect of the present invention, there is provided a method of forming a multiple-color image in which each of a plurality of photosensitive members is exposed with a scanning beam thereby obtaining a corresponding one of images. The method includes obtaining positioning displacement characteristics of each of the scanning beams in advance, the positioning displacement characteristics indicative of a relation between temperature and a displacement amount by which each of the scanning beams is displaced in a sub-scanning direction; and performing a displacement control based on the positioning displacement characteristics by shifting the positioning displacement characteristics in a direction opposite to that of a trend of the positioning displacement characteristics within a pixel pitch.

According to another aspect of the present invention, there is provided an image forming apparatus. The image forming apparatus includes an image forming unit that forms a multiple-color image in which each of a plurality of photosensitive members is exposed with a scanning beam thereby obtaining a corresponding one of images; and a scanning-beam control unit that performs a displacement control based on positioning displacement characteristics of each of the scanning beams by shifting the positioning displacement characteristics in a direction opposite to that of a trend of the positioning displacement characteristics within a pixel pitch. The positioning displacement characteristics are indicative of a relation between temperature and a displacement amount by which each of the scanning beams is displaced in a sub-scanning direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 2:
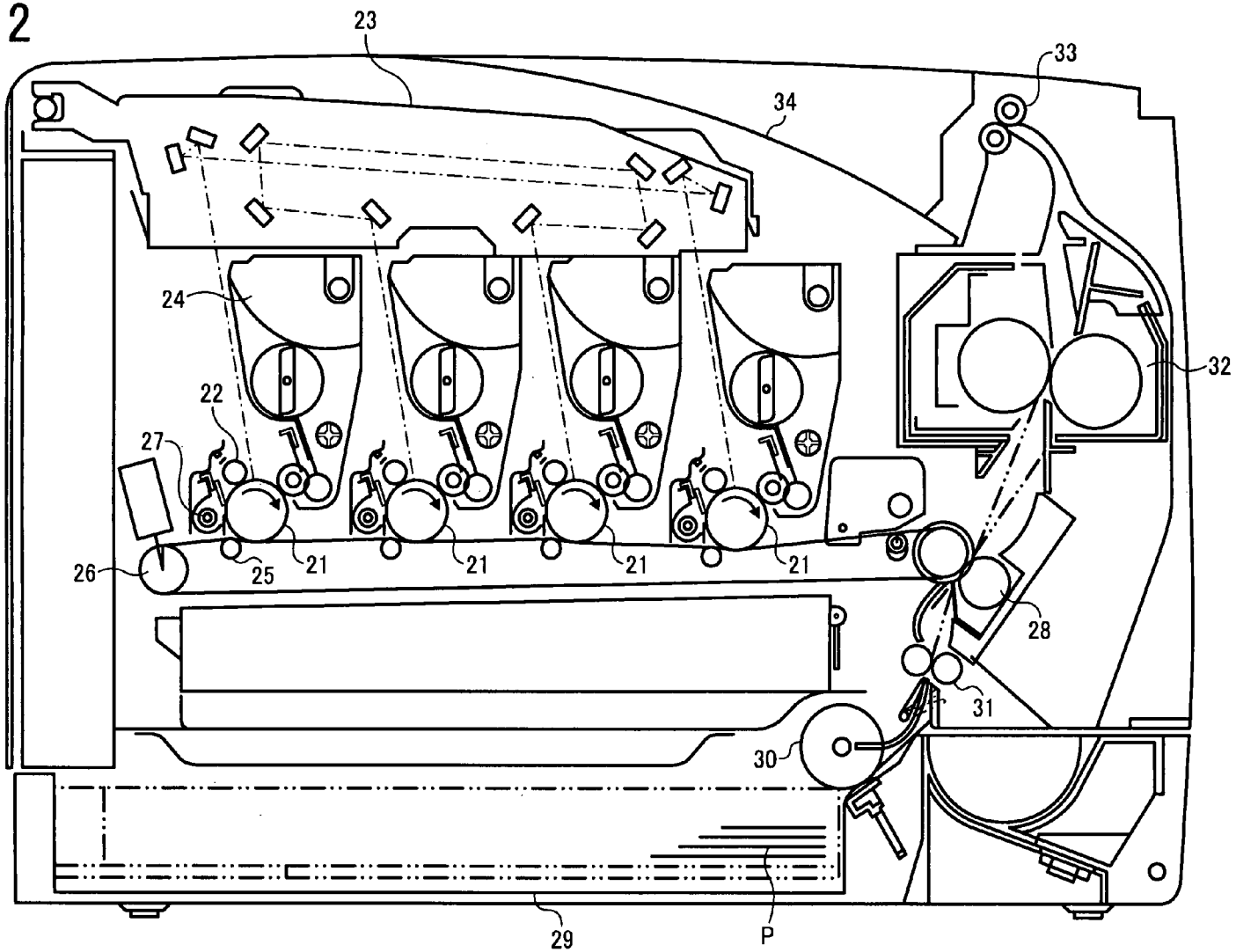
FIG. 2 is a schematic diagram of a color-image forming apparatus according to the embodiment.

FIG. 2 is a schematic diagram of a color-image forming apparatus according to an embodiment of the present invention. Around each of four photosensitive drums 21 corresponding to each color (black, yellow, cyan, and magenta) are arranged a charging unit 22, an exposing unit in the form of an optical scanning device (exposure unit) 23, a developing unit 24, a transfer unit 25, a transfer belt 26, and a cleaning unit 27, respectively, sequentially in the direction of rotation of the photosensitive drum 21. As shown in FIG. 2, the reference numerals of the various components are shown only around the leftmost photosensitive drum 21. The remaining three photosensitive drums 21 have the same array of components around them and hence not shown.

The charging unit 22 is a conductive roller. A charging bias voltage is supplied to the charging unit 22 from a power supply unit and the surface of the photosensitive drum 21 is uniformly charged.

The optical scanning device 23 equipped with a laser source, which intermittently switches based on image data, exposes the surface of the photosensitive drum 21 by a laser beam and creates an electrostatic latent image on the photosensitive drum 21.

The developing unit 24 develops the electrostatic latent image created on the photosensitive drum 21 into a visible image using a toner developer. A toner image on each photosensitive drum 21 is transferred to the transfer belt 26 by the transfer unit 25 and created as a color image on the transfer belt 26. The color image on the transfer belt is further transferred to a transfer sheet P by a transfer roller 28.

The transfer sheets P are stored in a sheet feeding cassette 29, separated by a sheet feeding roller 30 one at a time, transferred first to a resist roller 31 and then to the transfer roller 28.

The transfer sheet P with the image formed thereon is transferred to a fixing device 32, toner fixing is performed under heat and pressure, and discharged to a discharge tray 34 by a discharge roller 33 disposed on the main apparatus.

The cleaning unit 27 removes and collects residual toner on the surface of the photosensitive drum 21 after image transfer.

Figure 1:
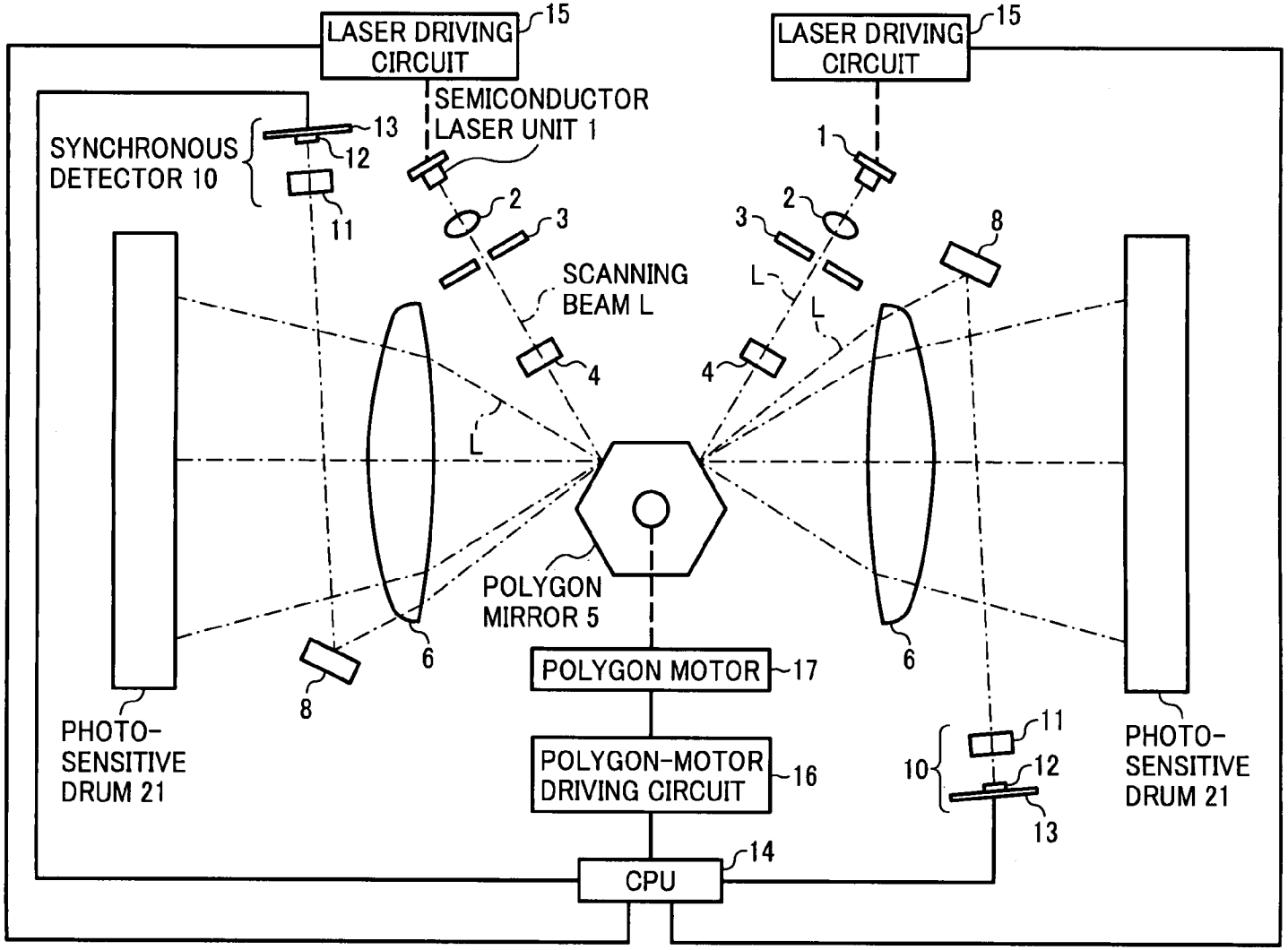
FIG. 1 is a schematic diagram of an optical scanning device according to an embodiment of the present invention.

FIG. 1 is a schematic diagram of the optical scanning device according to the embodiment. A laser beam L emitted from each of a plurality of semiconductor laser units 1 (two units are shown in FIG. 1) that oscillates the laser beams, respectively passes through a collimating lens 2, undergoes beam shaping by an aperture 3, and reaches a cylindrical lens 4 that serves as a linear imaging optical system. The cylindrical lens 4 has optical power in a sub-scanning direction and converges the laser beam L close to a reflective surface of an optical deflector (polygon mirror) 5.

The laser beam L reflected by the optical deflector 5 is deflected with a uniform angular speed due to the polygon mirror rotating at a constant speed, passes through a scanning lens 6, and reaches the photosensitive drum 21. A not shown mirror is suitably placed in a light path between the optical deflector 5 and the photosensitive drum 21.

Before being scanned by the photosensitive drum 21, the laser beam L is first reflected by a mirror 8 and synchronous signals are obtained by a synchronous detector 10. The synchronous detector 10 includes a lens 11, a light receiving element 12, and a synchronous detection plate (signal-generating circuit board) 13.

As shown in FIG. 1, a central processing unit (CPU) 14 receives the detection signals or various sensor signals from the synchronous detection plate 13, performs processing based on internal programs, and outputs control signals to a laser driving circuit 15 and a polygon-motor driving circuit 16. A polygon motor 17, which is controlled by the polygon-motor driving circuit 16, further drives the polygon mirror 5 as described later.

A color shift correction control, which is the salient feature of the embodiment, is described below.

When a color-image forming apparatus is powered on, the CPU 14 receives an ON signal and executes an automatic color alignment mode. The automatic color alignment mode sets a condition for image formation to maintain a high quality of the image at a very first stage.

There is a laser beam L emitted from the semiconductor laser unit 1 corresponding to each of the colors black, yellow, cyan, and magenta of the color-image forming apparatus. In the automatic color alignment mode, the current color shift amount is measured, the correction value is calculated, and the correction is performed.

The automatic color alignment mode is a correction control mode in which, the color image created on the transfer belt 26 is scanned with sensors, the sensor signals are received by the CPU 14, the position of each color image in a main scanning direction and a sub-scanning direction is calculated, drive signals are output to the laser driving circuit 15 etc. to align the position of each color image based on a calculated value, thereby matching image formation timings for all colors.

Figure 3:
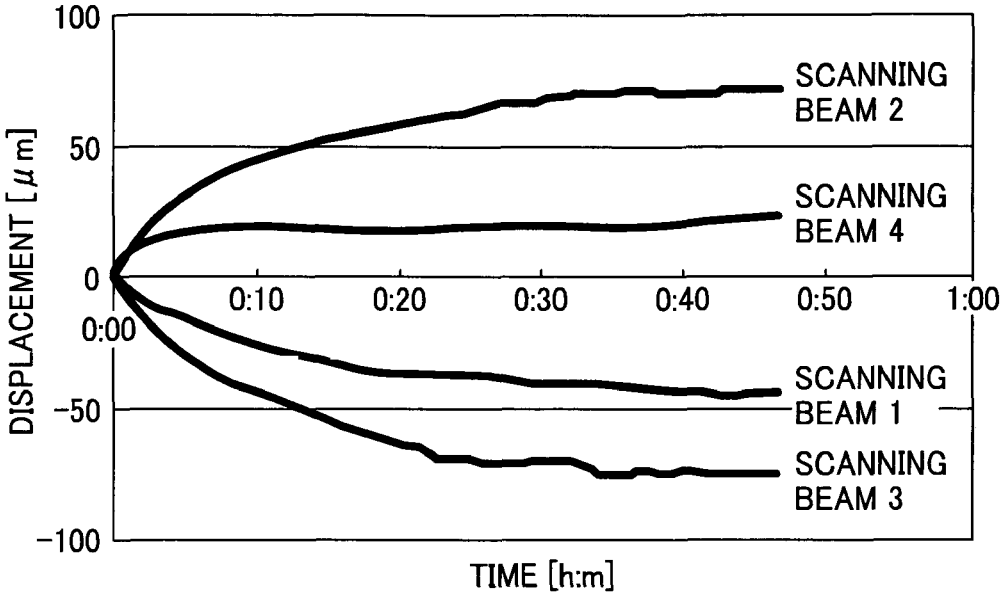
FIG. 3 is a graph explaining a relation between a displacement amount of each scanning beam in a sub-scanning direction and time according to the embodiment.

FIG. 3 is a graph explaining a relation between the displacement amounts (cause of color shift) of the scanning beams 1 to 4 of each color in the sub-scanning direction and time. The trend of the displacement (color shift) of each scanning beam 1 to 4 with the passage of time can be found.

As shown in FIG. 3, the trend of the displacement of the four scanning beams in the sub-scanning direction with the passage of time is expressed as zero displacement at an initial state (at time zero). For the sake of understanding, the initial state is assumed as zero. However, all of the four scanning beams 1 to 4 may not coincide with zero at actual initial state and can be relatively on a positive side or a negative side.

As shown in FIG. 3, when setting the correction value calculation for the first time based on the trend of displacement of the four scanning beams 1 to 4 in the sub-scanning direction due to increase in temperature, it is set such that the earlier trend of displacement is balanced out. Specific conditions 1 to 6 are as described below.

Condition 1 The scanning beam 1 is assumed to be a reference beam.

Condition 2 The displacement of each of the four scanning beams 1 to 4 should be within one pitch of the image resolution from the scanning beam 1.

Condition 3 A displacement amount of the scanning beam 1 is greater than or equal to a displacement amount of the scanning beam 2.

Condition 4 A displacement amount of the scanning beam 1 is greater than or equal to a displacement amount of the scanning beam 4.

Condition 5 A displacement amount of the scanning beam 3 is greater than or equal to a displacement amount of the scanning beam 2.

Condition 6 A displacement amount of the scanning beam 3 is greater than or equal to a displacement amount of the scanning beam 4.

By setting the scanning beams as mentioned above, the color shift in the sub-scanning direction occurring at the beginning of image formation and also the color shift in the sub-scanning direction with the passage of time can be reduced.

When the displacement of the scanning beams is as shown in FIG. 3, a difference between the displacement amount of the scanning beam 2 (maximum displacement amount on the positive side) and the displacement amount of the scanning beam 3 (maximum displacement on the negative side) becomes maximum. Therefore, in the automatic color alignment mode at the initial state, as mentioned in the conditions 3 to 6, if the scanning beams 1 and 3 displaced on the negative side are set relatively on the positive side than the scanning beams 2 and 4 displaced on the positive side, the difference in the subsequent displacements can be reduced.

Figure 4:
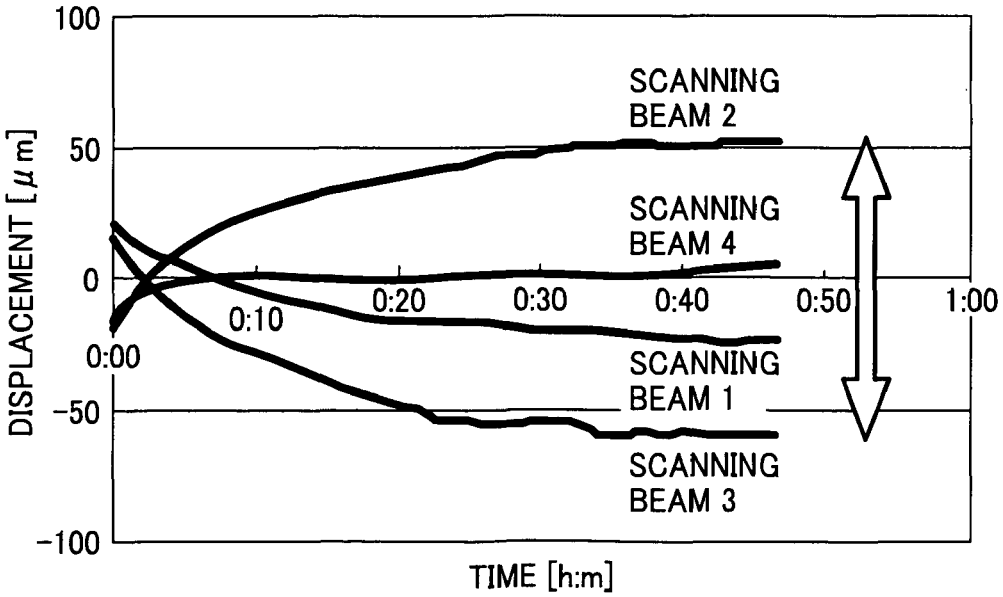
FIG. 4 is a graph for explaining how to suppress temporal increase in the displacement amount according to the embodiment.

Thus, as shown in FIG. 4, the difference in the displacements (indicated by a double-headed arrow) after the passage of time can be reduced. In other words, by setting the position of the scanning beam in the sub-scanning direction at time zero in a direction opposite to an anticipated displacement direction, the difference in the displacements after the passage of time can be reduced.

In the automatic color alignment mode, which includes a mode immediately after the image forming apparatus is powered ON and the automatic color alignment mode that takes over in the subsequent image formation process, the trend of displacement is expected to differ in the latter mode. Therefore, in the former mode, the color alignment described earlier is executed. In the latter mode, because the conditions 3 to 6 no longer exist, a normal correction control is carried out. However, there are instances when the conditions 3 to 6 are valid.

When image formation is continued non-stop, temperature-inside the apparatus increases due to heat generated by various driving sources. Therefore, it is important to detect whether the image formation is non-stop or discrete.

Image formation can be determined to be non-stop if the driving ratio in a certain period exceeds a specific value. Thus, by suitably setting the driving ratio in a period or by setting a plurality of driving ratios in a plurality of periods, a steep variation or a smooth variation can be detected.

Figure 5:
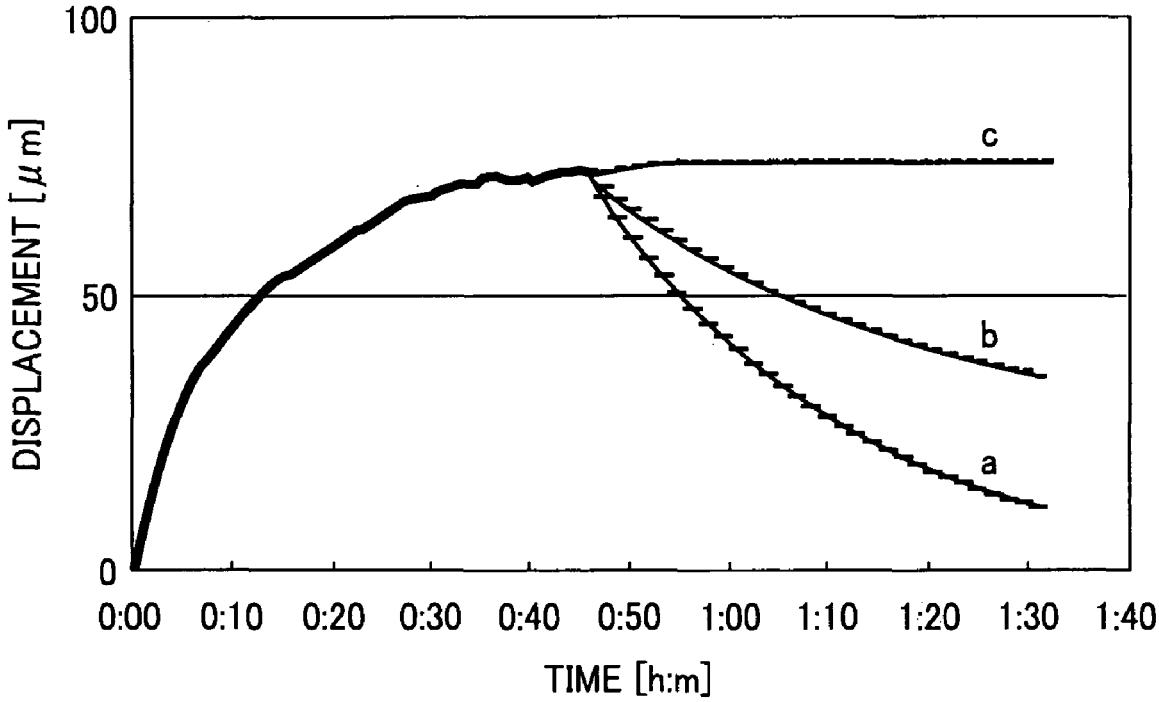
FIG. 5 is a graph for explaining a displacement variation due to a temperature change according to the embodiment.

In other words, the state that changes due to the increase in temperature also changes with respect to a decrease in temperature as shown in FIG. 5 by lines "a" and "b" (in FIG. 5, only one scanning beam out of four is shown).

The steepness of displacement in the sub-scanning direction depends on the steepness of decrease in temperature. It can be expected that when the decrease in temperature is steep, the displacement is steep, which is represented by the line "a" and when the decrease in temperature is smooth, the displacement is smooth, which is represented by the line "b".

For example, if the passage of 40 minutes includes automatic correction and if the temperature starts decreasing after that, the four scanning beams start shifting in the direction opposite to the current direction resulting in commencement of color shift.

By relaxing the decrease in temperature, the trend of displacement can be reduced. Therefore, decrease in temperature can be controlled by driving the optical deflector, which serves as a heat generating source. Ideally, if a status as represented by a line "c" is created, the color shift can be prevented.

The displacement detection can be carried out by various ways such as measuring the scanning beam position, measuring the temperature instead of the scanning beam, and measuring a driving time of the optical deflector instead of the scanning beam.

For example, the increase in temperature due to driving of the polygon mirror 5, which serves as the optical deflector, is comparatively steep. Thus, by driving the polygon mirror 5 for a short time, the displacement of the scanning beam can be reduced. Specifically, upon receiving driving control signals from the polygon motor driving circuit 16, the CPU 14 detects that the period for which the polygon mirror 5 continues to be in an idle state is of a specific ratio in a predetermined period.

For example, the CPU 14 performs a timer management and if there is no image formation for 30 minutes, the polygon mirror 5 is driven for ten seconds. If there is the 30-minute image formation but a period the polygon mirror 5 has been driven within the 30-minute image formation is less than 30 seconds, the polygon mirror 5 is driven for a given period to cause the total period to reach 30 seconds.

In the image forming apparatus equipped with the optical deflector such as the polygon mirror 5 according to the embodiment, if the scanning beam is displaced from the initial state and supposedly, if the state continues, because the color alignment has been carried out once, color settings remain valid for the subsequent time and the color shift is reduced. Thus, by managing to drive the polygon mirror 5 when the image formation is not taking place, the image forming apparatus can continue to output images with no color shift.

A rotation frequency of the polygon mirror 5 can change according to a clock frequency input from outside the device. Therefore, in the embodiment, the rotation frequency of driving the polygon mirror 5 when there is no image formation taking place can be set lower than a rotation frequency required for the image formation.

Thus, to reduce noise and frequency when driving the polygon mirror 5, the frequency can be suitably selected such that negligible noise is produced from the device.

According to an embodiment of the present invention, by setting a measurement origin based on displacement trend data at a first step of the displacement control, the difference in the subsequent displacements can be reduced. Further, dealing with the correction that varies with time becomes easy. As a result, it is possible to obtain a full-color image with averagely-less color shift.

Moreover, a full-color image with high quality and reduced color shift can be formed using the image forming method.

Furthermore, by performing a constant correction control, a full-color image with reduced color shift can be formed.

Moreover, by carrying out correction control as the initial setting, a steady control can be maintained after the passage of time.

Furthermore, the steady control can certainly be executed after the passage of time.

Moreover, the proper control can be performed in response to a steep color shift arising after the passage of time.

Furthermore, a proper correction can be performed also in a case of short image-formation time.

Moreover, by stabilizing a driving state, a color shift stabilization state occurring after the passage of time can be maintained.

Furthermore, along with enabling maintaining the color shift stabilization state occurring after the passage of time by stabilizing the driving state, driving noise can also be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming method for forming a multiple-color image using a plurality of photosensitive bodies, each of the photosensitive bodies of the plurality of photosensitive bodies corresponding to a different color, the method including exposing the photosensitive bodies to a plurality of scanning beams, each of the scanning beams of the plurality of scanning beams corresponding to one of the photosensitive bodies of the plurality of sensitive bodies, the method comprising:

measuring positional displacements of each of the scanning beams of the plurality of scanning beams in a sub-scanning direction to obtain measurement values; and performing a positional displacement correction for each of the scanning beams of the plurality of scanning beams based on the measurement values, the measuring includes measuring, in advance, displacement amounts of scanning positions of each of the scanning beams of the plurality of scanning beams in the sub-scanning direction, the displacement amounts changing according to temperature rise to obtain trends in changes in the displacement amounts, and the performing includes starting a control by setting the scanning positions within a pixel pitch based on the measured displacement amounts to counter the trends in changes in the displacement amounts of the scanning beams, wherein setting the scanning positions includes setting the positions of the scanning beams in the sub-scanning direction at time zero in directions opposite to anticipated displacement directions based on the trends in changes in the displacement amounts.

2. The method according to claim 1, wherein the positional displacement correction is performed only when the positional displacement correction of the scanning beams is started immediately after an image forming apparatus which performs the method is powered ON.

3. The method according to claim 1, wherein the positional displacement correction is not performed when an accumulated number of formed images reaches a predetermined number or when a number of images formed in succession reaches a predetermined number.

4. The method according to claim 3, wherein a formed image is counted as one of the images formed in succession when a driving period of an optical deflector within a set period of time exceeds a length, the optical deflector deflecting the scanning beam.

5. The method according to claim 1, wherein the positional displacement correction is performed when a driving period an optical deflector within a set period of time exceeds length, the optical deflector deflecting the scanning beam.

6. The method according to claim 5, wherein two different time periods are set as the set period of time, and a driving ratio is set for each of the time periods, and the positional displacement correction is performed when an actually measured driving ratio exceeds the set driving ratio.

7. The method according to claim 5, wherein the optical deflector is driven for a predetermined time period at time intervals during a period when the image is not formed.

8. The method according to claim 5, wherein the driving period with a time period is set in advance for the optical deflector, and when an actual driving period of the optical deflector falls short of the set driving period, the optical deflector is driven for a time corresponding to a difference between the actual driving period and the set driving period.

9. The method according to claim 7, wherein the optical deflector is driven by a number of rotations which is smaller than a number of rotation during a time when an image is formed.

10. The method according to claim 8, wherein the optical deflector is driven by a number of rotations which is smaller than a number of rotation during the time when an image is formed.

11. An image forming apparatus comprising:

an image forming unit configured to form a multiple-color image, the image forming unit including a plurality of photosensitive bodies, each of the photosensitive bodies of the plurality of photosensitive bodies corresponding to a different color, and a plurality of beam generators configured to generate a plurality of scanning beams, each of the plurality of scanning beams of the plurality of scanning beams corresponding to each of the plurality of photosensitive bodies of the plurality of photosensitive bodies to expose the plurality of photosensitive bodies; and a scanning-beam control unit configured to measure a positional displacement of each of the scanning beams of the plurality of scanning beams in a sub-scanning direction to obtain a measurement value, and perform a positional displacement correction based on the measurement value of each of the scanning beams, wherein the scanning-beam control unit is further configured to measure a displacement amount of a scanning position of each of the scanning beams in the sub-scanning direction in advance, and determine a trend in changes in displacement amounts, which changes according to temperature rise, and set the scanning positions within a pixel pitch based on the result of measurement to counter the trend in changes in the displacement amounts of the scanning beams.

* * * * *